US007170484B2

(12) United States Patent
Miyazawa

(10) Patent No.: US 7,170,484 B2
(45) Date of Patent: Jan. 30, 2007

(54) DISPLAY DEVICE

(75) Inventor: Toshio Miyazawa, Chiba (JP)

(73) Assignee: Hitachi Displays, Ltd., Mobara (JP)

( * ) Notice: Subject to any disclaimer, the term of this patent is extended or adjusted under 35 U.S.C. 154(b) by 309 days.

(21) Appl. No.: 10/932,103

(22) Filed: Sep. 2, 2004

(65) Prior Publication Data

US 2005/0057478 A1 Mar. 17, 2005

(30) Foreign Application Priority Data

Sep. 2, 2003 (JP) ..... 2003-309472

(51) Int. Cl.
*G09G 3/36* (2006.01)

(52) U.S. Cl. ..... 345/90; 345/204

(58) Field of Classification Search ..... 345/55, 345/76, 82, 84, 87–98, 204, 690; 315/169.1–169.3
See application file for complete search history.

(56) References Cited

U.S. PATENT DOCUMENTS

2001/0052890 A1 12/2001 Miyazawa
2002/0036625 A1 3/2002 Nakamura
2002/0039087 A1* 4/2002 Inukai ..... 345/76
2002/0089496 A1* 7/2002 Numao ..... 345/204
2002/0093472 A1* 7/2002 Numao ..... 345/87
2003/0193513 A1 10/2003 Miyazawa

FOREIGN PATENT DOCUMENTS

JP 2001-356743 12/2001
JP 2002-175040 6/2002
JP 2003-302945 A 10/2003

* cited by examiner

*Primary Examiner*—Regina Liang
(74) *Attorney, Agent, or Firm*—Antonelli, Terry, Stout and Kraus, LLP.

(57) ABSTRACT

A circuit configuration is simplified to enable a color display of a high aperture ratio and multiple gradations to have no malfunction A first transistor pair composing a first inverter and a second transistor pair composing a second inverter, while bridging alternating power sources φp and φn, are caused to act as an output circuit to a pixel electrode. Diodes D1 and D2 having the same forward direction as the conduction direction of the first transistors are inserted into the series circuit of the first transistor pair, and the common node of the diodes is connected with the output of a switching transistor. A capacitor is connected between a common node of control electrodes of the second transistor pair and a series connection intermediate node of the second transistor pair so that the written state of data is controlled by making use of charges stored in the capacitor.

6 Claims, 9 Drawing Sheets

DISPLAY DEVICE

The present application claims priority from Japanese application JP2003-309472, filed on Sep. 2, 2003, the content of which is hereby incorporated by reference into this application.

BACKGROUND OF THE INVENTION

The present invention relates to an active matrix type display device; and, more particularly, the invention relates to a display device which can display pixel memory type multiple gradations having a high aperture ratio and a high definition.

Display Devices of various types using a liquid crystal panel or electroluminescence (especially, an organic EL device) have been put into practice or investigated for commercial development as a display device of a high fineness in producing a color display for a notebook type computer or a display monitor. The display device being used most widely is a liquid crystal display device, which will be described by taking the so-called "active matrix type liquid crystal display device" as a typical example.

In a thin film transistor (TFT) type of active matrix type liquid crystal display device, thin film transistors TFT provided for the individual pixels are used as switching elements for applying signal voltages (or video signal voltages: gradation voltages) to the pixel electrodes. Therefore, no crosstalk occurs between the pixels, so that multiple gradations can be displayed with high definition.

In a case in which a liquid crystal display device of this kind is mounted on an electronic device using a battery as its power source, such as a mobile type information terminal, on the other hand, it is necessary to reduce the power to be consumed for the display. Therefore, many techniques designed to give a memory function to each pixel of the liquid crystal display device have been proposed in the related art.

FIG. 7 is a diagram which shows an example of a liquid crystal panel, in the form of a low temperature poly-silicon thin film transistor type liquid crystal display device having a static RAM of one bit packaged in each pixel. The liquid crystal panel is formed by clamping a liquid crystal material in the gap, across which a first substrate and a second substrate confront each other. In FIG. 7, reference letters PNL designate a liquid crystal panel, in which the first substrate has a vertical scanning circuit GDR and a horizontal scanning circuit DDR in the periphery of a pixel portion (or display area) AR occupying most of the plane of the panel. Each of the pixels of the pixel portion (or pixel array) AR constitutes an image memory (or static RAM: SRAM) of one bit. This liquid crystal panel PNL has a digital-analog conversion circuit (DAC) of four bits or the like packaged in its horizontal scanning circuit DDR, although this is not indispensable.

FIG. 8 is a circuit diagram showing the 1-bit SRAM in FIG. 7 schematically. In FIG. 8: reference letters GL designate a gate line (or scanning line); DL designates a drain line (or signal line); LC designates a liquid crystal; and VCOM designates a common voltage. Reference letters PIX designate a pixel circuit. This pixel circuit PIX is composed of: a switching transistor T1 for fetching a display signal inputted from the drain line DL, on the basis of a scanning voltage applied to the gate line GL; the liquid crystal LC; and a pair of transistors T2 and T3 for fetching and reading the video signal in and from the image memory SRAM. The pixel circuit PIX has an ordinary sampling function to feed gradation analog signals of 4 to 6 bits from the outside, as they are, to the liquid crystal driving electrode, and an image memory function to store data of 1 bit received from the outside once in the SRAM, in response to alternating voltages ϕp and ϕn, and to output data conforming to that 1-bit data to the liquid crystal driving electrodes.

The selection of the actions of the sampling function and the image memory function is controlled from the outside. Here, the alternating voltages ϕp and ϕn are alternating signals synchronized with the liquid crystal alternating voltage period which alternate in polarities reversed from each other. The voltage ϕn is indicated to have a waveform reversed from that of the voltage ϕp. If this pixel configuration is adopted, the electric power to be consumed for writing the data can be reduced by displaying the 1-bit data stored in the SRAM, for example, at a standby time or the like of the mobile telephone.

Here, a display device of the areal gradiation display configuration having a 1-bit memory is disclosed, for example, in Patent Publication 1.

Patent Publication No. 1: JP-A-2002-175040

SUMMARY OF THE INVENTION

FIG. 9 is a circuit diagram showing one example of a one-pixel circuit of a liquid crystal display device having an image memory function, which has already been proposed by the present applicant. In the first substrate of the liquid crystal display device, a drain line DL1, comprising one of numerous drain lines DL, configures a wiring line for feeding the video signal to the pixel, and selecting signal lines HADL1 and VADL are wiring lines for selecting a pixel to which the video signal is applied. Reference letters VCOM designate a common voltage or a fixed voltage, which belongs to the second substrate side in the so-called "TN type liquid crystal panel". The pixel has a function to hold the applied video signal for a time period until it is selected and rewritten. Here, an organic EL display device or the like can be provided if the liquid crystal LC is replaced by an organic electroluminescence element (or organic EL) or the like.

The fixed voltage VCOM is applied to a fixed voltage line VCOM-L. The fixed voltage VCOM is connected with an electrode formed on the second substrate across the liquid crystal LC. Alternating voltages PBP (corresponding to the voltage ϕp in FIG. 8) and PBN (corresponding to the voltage ϕn in the same) are applied to alternating voltage lines PBP-L and PBN-L.

The video signal is written in the pixel when two NMOS transistors VADSW1 and HADSW1 are turned ON, with the individual selecting signals to be applied to the selecting signal line HADL1, comprising one of the selecting signal lines HADL, and the selecting signal line VADL.

There is a first inverter, which uses a written video signal potential as an input gate (or voltage node N8) potential and in which the electrodes or diffusion regions to become the individual sources or drains of a transistor pair, consisting of p-type field effect transistor (PMOS) PLTF1 and n-type field effect transistor (NMOS) NLTF1, are electrically connected to form an output portion (or voltage node N9). This voltage node will be merely referred to as a "node".

A second inverter is composed of a transistor pair consisting of p-type field effect transistor (PMOS) PLTR1 and n-type field effect transistor (NMOS) NLTR1 having as an input gate potential the potential of the output portion (or node N9), at which the electrodes or diffusion regions to become individual sources or drains of the paired p-type field effect transistor (PMOS) PLTF1 and the n-type field effect transistor (NMOS) NLTF1 composing the first inverter are electrically connected.

A third inverter is composed of a transistor pair consisting of p-type field effect transistor (PMOS) PPVS1 and n-type field effect transistor (NMOS) NPVS1 having as an input gate potential the potential of the output portion (or node N8), at which the electrodes or diffusion regions to become individual sources or drains of the paired p-type field effect transistor PLTR1 and the n-type field effect transistor NLTR1 composing the second inverter are electrically connected.

At the same time, the output portion (or node N8) of the paired p-type field effect transistor PLTR1 and n-type field effect transistor NLTR1, which form composing the second inverter, is electrically connected with the input gate (or node N8) of the first inverter. The electrodes or diffusion regions (or node N6) to become the sources or drains of the n-type field effect transistors NLTF1 and NLTR1, which form the first and second inverters, but are not to become outputs of the inverts, are connected with one (PBN) of the paired alternating voltage lines.

Moreover, the electrodes or diffusion regions (or node N4) to become the sources or drains of the p-type field effect transistors PLTF1 and PLTR1, which form composing the first and second inverters, but are not to become outputs of the inverters, are connected with the alternating voltage line PBP of the voltage pairing the alternating voltage line (or the node N6), at which the electrodes or diffusion regions to become the sources or drains, but are not to become the inverter outputs of the n-type field effect transistors of the first and second inverters, are connected.

One (or the node N6) of the electrodes or diffusion regions to become sources or drains, which are not the output portion (or node N10) of the paired p-type field effect transistor PPVS1 and n-type field effect transistor NPVS1 composing the third inverter, is connected with either (PBN) of the alternating voltage lines, but the other is connected with the fixed voltage line VCOM (or node N3).

The number of colors to be realized by the 1-bit SRAM are two for each of the individual colors R, G and B so that their total is 2×2×2=8 colors. However, the number of colors for the color display are so small that the application is limited to a method for reducing the electric power for writing the data by displaying the 1-bit data stored in the SRAM at the aforementioned standby time of the mobile telephone.

FIG. 10 is a diagram showing an example of an areal gradation pixel, in which the unit pixels described in conjunction with FIG. 9 are combined. In this example, the areas of pixel electrodes composing each unit pixel are combinations of three kinds of a cell CL-A, a cell CL-B and a cell CL-C having different areas. Displays of three bits and eight gradations can be performed by combining those cells of different areas selectively. These cells are configured for each of the colors (R, G and B) to make a one-color pixel capable of producing multicolor displays.

In the pixel memory system described with reference to FIG. 9, however, the wire number and the transistor number are increased, resulting in an enlarged circuit scale. Therefore, it is restrictive to reduce the power consumption and difficult to improve the aperture ratio. In the configuration described with reference to FIG. 10, moreover, the circuit configuration and the configuration of the pixel electrodes are complicated, so that it is difficult to lower the manufacturing cost. As a countermeasure for this, the applicant of this invention has proposed a configuration to be described in the following.

FIG. 11 is a circuit diagram showing another example of one pixel of a liquid crystal display device having an image memory circuit, which has already been proposed by the present applicant. FIG. 12 is a top plan view showing one example of the layout in a display area of one color pixel of the case in which 256 colors are displayed with data of gradations of three bits for R, three bits for G and two bits for B.

The basic operations of FIG. 11 are similar to those of FIG. 9. However, this configuration is different in that the data holding transistor pair (or the CMOS transistor pair) acts as an output circuit to a pixel electrode PX. The image memory (or storage circuit) is provided with a first transistor pair composed of a transistor (NMOS) NM2 and a transistor (PMOS) PM2 connected in series, while bridging the paired power lines φp and φn, and a second transistor pair composed of a transistor (NMOS) NM3 and a transistor (PMOS) PM3 connected in series, while bridging the paired power lines φp and φn.

The paired power lines φp and φn are fed with AC voltages varying in polarities opposite to each other. The common node of the control electrodes of the transistor NM2 and the transistor PM2 composing the first transistor pair of the memory circuit is connected with the series connection intermediate node (or node) N2 of the transistors NM3 and PM3 composing the second transistor pair. Moreover, the common node of the control electrodes of the transistor NM3 and the transistor PM3 composing the second transistor pair is connected with the series connection intermediate node (or node) N1 of the transistor NM2 and the transistor PM2 composing the first transistor pair.

An NMOS transistor NM1 operates as a switching element (or transistor). This switching element NM1 is selected by the gate line GL to connect a video signal fed from the drain line DL to the node N1 of the transistor NM2 and the transistor PM2 composing the first transistor pair. The output node of the switching element NM1 is connected with the node N1 of the transistor NM2 and the transistor PM2 composing the first transistor pair, and the node N2 of the transistor NM3 and the transistor PM3 composing the second transistor pair is connected with the pixel electrode of the unit pixel PX. A bootstrap capacitor CB is inserted between the node N2 of the transistor NM3 and the transistor PM3 composing the second transistor pair and the common node of the control electrodes. Reference letters CS designate a floating capacitor.

In FIG. 12: reference letters CX designate a one color pixel; R1, R2 and R3, and G1, G2 and G3 designate division unit pixel electrodes of red (R) and green (G) to be controlled by areal gradations individually corresponding to 3-bit data; and B1 and B2 designate division unit pixel electrodes of blue (B) to be controlled by areal gradations individually corresponding to 2-bit data. The division unit pixel electrodes R1, R2 and R3 compose the unit pixel for R; the division unit pixel electrodes G1, G2 and G3 compose the unit pixel for G; the division unit pixel electrodes B1 and B2 compose the unit pixel for B. The division unit pixel electrodes are the aforementioned liquid crystal drive electrodes.

The unit pixels for R and G are selected by the switching elements NM1, which are individually connected with the gate line GL and the three drain lines DL(R1), DL(R2) and DL(R3) and DL(G1), DL(G2) and DL(G3) for feeding 3-bit data. Each unit pixel is provided with image memories SRAM of a number corresponding to the bit number controlled by each switching element NM1, and the outputs of the image memories SRAM are electrically connected with the division unit pixel electrodes through contact holes CTH.

The individual unit pixels for R, G and B have equal sizes in the extending direction of the gate line GL. The individual unit pixels for R and G are divided into the divided unit pixels at the ratios of "3", "6" and "12" in the extending direction of the drain lines DL, and the unit pixels for B are divided into the divided unit pixels at the ratios of "7" and "14". The areal gradations of 256 colors are realized by these divisions.

By the color pixels of the layout shown in FIG. 12, a color display of 256 colors can be realized with data consisting of a total of 8 bits consisting of R: 3 bits, G: 3 bits and B: 2 bits. The display data of no variation needs no data transfer for the individual frames and is provided by displaying the data stored in the memories, so that the power consumption can be reduced. Here, the display of more colors can be realized by increasing the bit numbers of the individual colors.

By thus providing the pixels themselves with a data holding function (or the memory function), it is not necessary to feed all of the data to every frame, but it is sufficient to rewrite only the data of the varied portions. Moreover, every data is subjected to the memory function, so that the pixels of the display region can be read out at random and displayed. In the case of such a random access display, it is sufficient to provide a random access circuit.

By the aforementioned circuit configuration of FIG. 11, the circuit scale can be far more simplified than that of FIG. 9. In this configuration, however, when the data is to be held in the image memories, malfunctions may occur, for example, at the transition time of the ON/OFF actions of the first transistor pair PM2 and NM2 of FIG. 11.

It is an advantage of the invention to provide a display device which is enabled by simplifying the circuit configuration so as to realize multiple colors with areal gradations and to prevent data from being erroneously written in the pixel memories, thereby to display colors at a high aperture ratio and in multiple gradations.

In accordance with the invention, the configuration is such that a CMOS transistor pair for holding a video signal is made to act as an output circuit to the pixel electrodes, and a capacitor is connected with the pixel electrodes to control the writing state in an SRAM by using charges stored in the capacitor. At the same time, diodes having identical conduction directions are inserted in series with the CMOS transistor pair for controlling the data write operation in the pixel memories. Representative configurations of the invention will be summarized in the following.

(1) According to the invention, there is provided a display device comprising: pixels disposed to correspond to portions, at which a plurality of scanning lines and a plurality of signal lines intersect, wherein each of the pixels includes a pixel electrode, a switching element for selecting the pixel electrode, and a storage circuit interposed between the pixel electrode and the switching element for storing data to be written in the pixel electrode; and a pair of alternating voltage power lines for applying alternating voltages, varying in polarities opposite to each other, to the storage circuit, wherein the storage circuit includes a first transistor pair of an NMOS transistor and a PMOS transistor connected in series, while bridging the paired alternating voltage power lines, and a second transistor pair of an NMOS transistor and a PMOS transistor connected in series, while bridging the paired alternating voltage power lines, wherein a common node of control electrodes of the first transistor pair is connected with the series connection intermediate node of the second transistor pair, whereas a common node of control electrodes of the second transistor pair is connected with the series connection intermediate node of the first transistor pair, wherein diodes having the same conduction direction as that of the NMOS transistor and the PMOS transistor composing the first transistor pair are connected in series with the NMOS transistor and the PMOS transistor composing the first transistor pair, respectively, wherein the output node of the switching element is connected with the node of the first transistor pair, whereas the series connection intermediate node of the second transistor pair is connected with the pixel electrode, and wherein a capacitor is connected between the common node of the control electrodes of the second transistor pair and the series connection intermediate node of the second transistor pair.

The diodes are preferably connected individually either across the series connection intermediate node of the first transistor pair or between the NMOS transistor and the PMOS transistor composing the first transistor pair and the paired alternating voltage power lines.

It is preferable that, assuming each of the pixels to be a unit pixel of one color, one color pixel is composed of a plurality of unit pixels, that the pixel electrodes of the individual unit pixels composing one color pixel are made of a plurality of electrodes having different areas, or that the plural electrodes are so selected by the switching element as to correspond to the gradation display of at least two bits.

According to the invention, it is possible to provide a color image display device of multiple gradations and high definition, in which the wire number and the transistor number are reduced and which can prevent malfunctions in operations to write or read the image memories and effect a reduction in the aperture ratio.

Here, the invention should not be limited to the aforementioned configuration and the configurations of embodiments to be described hereinafter, but is capable of being modified in various manners without departing from the technical concept thereof.

DESCRIPTION OF THE PREFERRED EMBODIMENTS

Embodiments of the display device of the invention will be described in detail with reference to the accompanying drawings. In the following description of the embodiments, a liquid crystal display device will be described by way of example, but the invention can naturally be applied similarly to a matrix type display device of the organic EL type or the like, as well.

[Embodiment 1]

Figure 1:
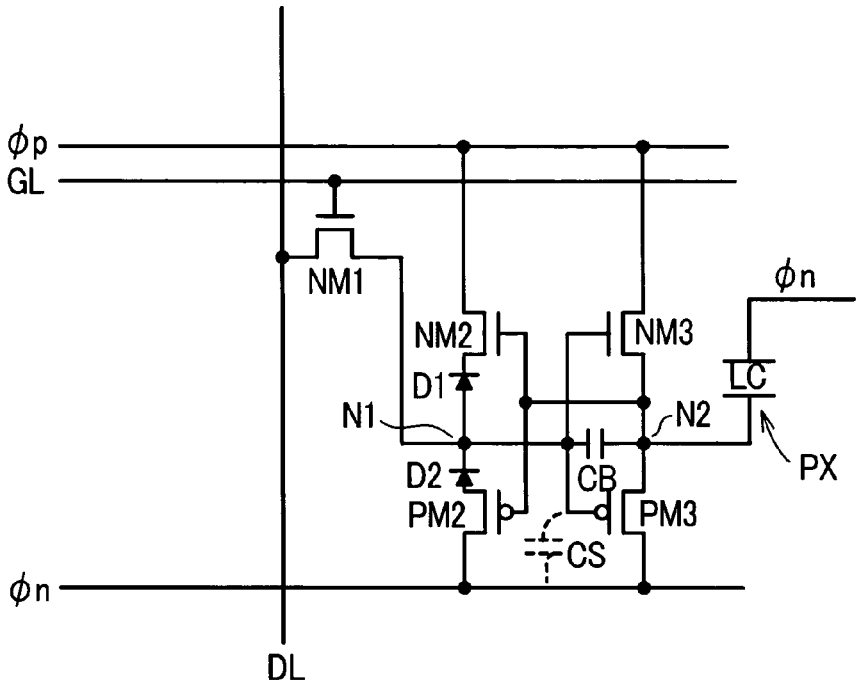
FIG. 1 is a circuit diagram of one pixel of a liquid crystal display device representing Embodiment 1 of the invention.
Figure 11:
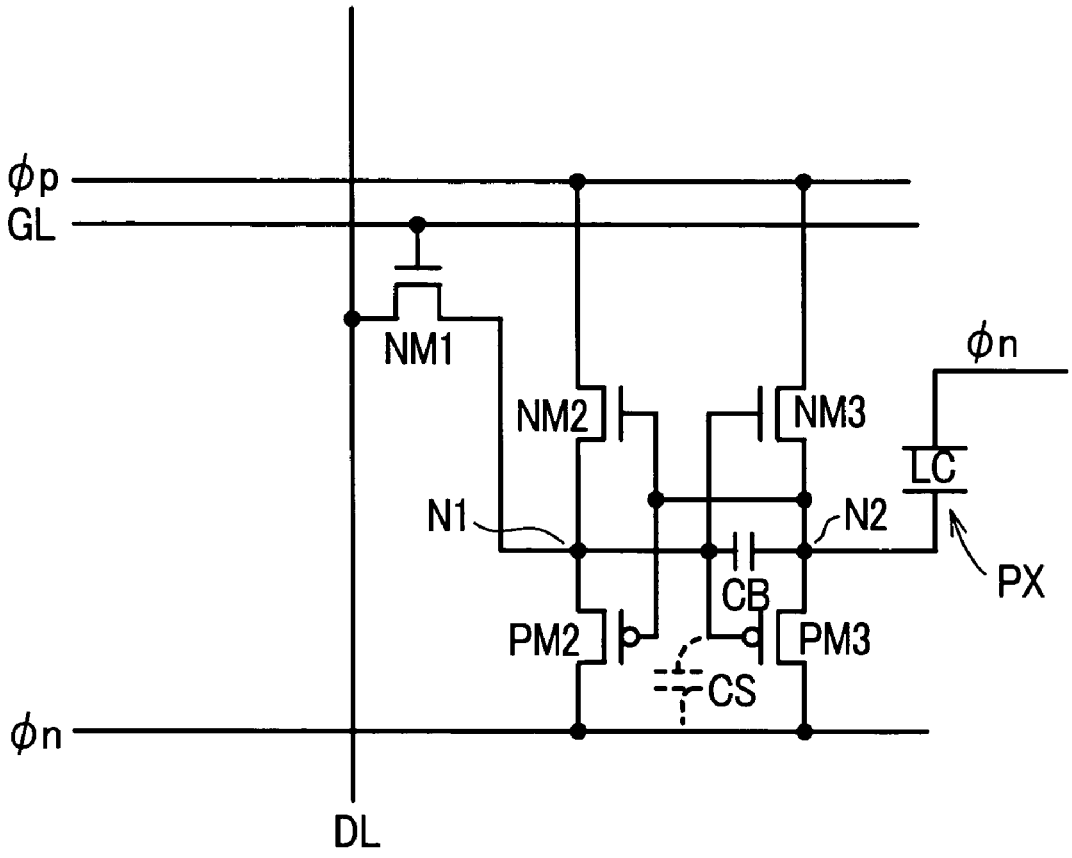
FIG. 11 is a circuit diagram showing another example of one pixel of a liquid crystal display device having an image memory circuit, which has already been proposed by the present applicant.
Figure 12:
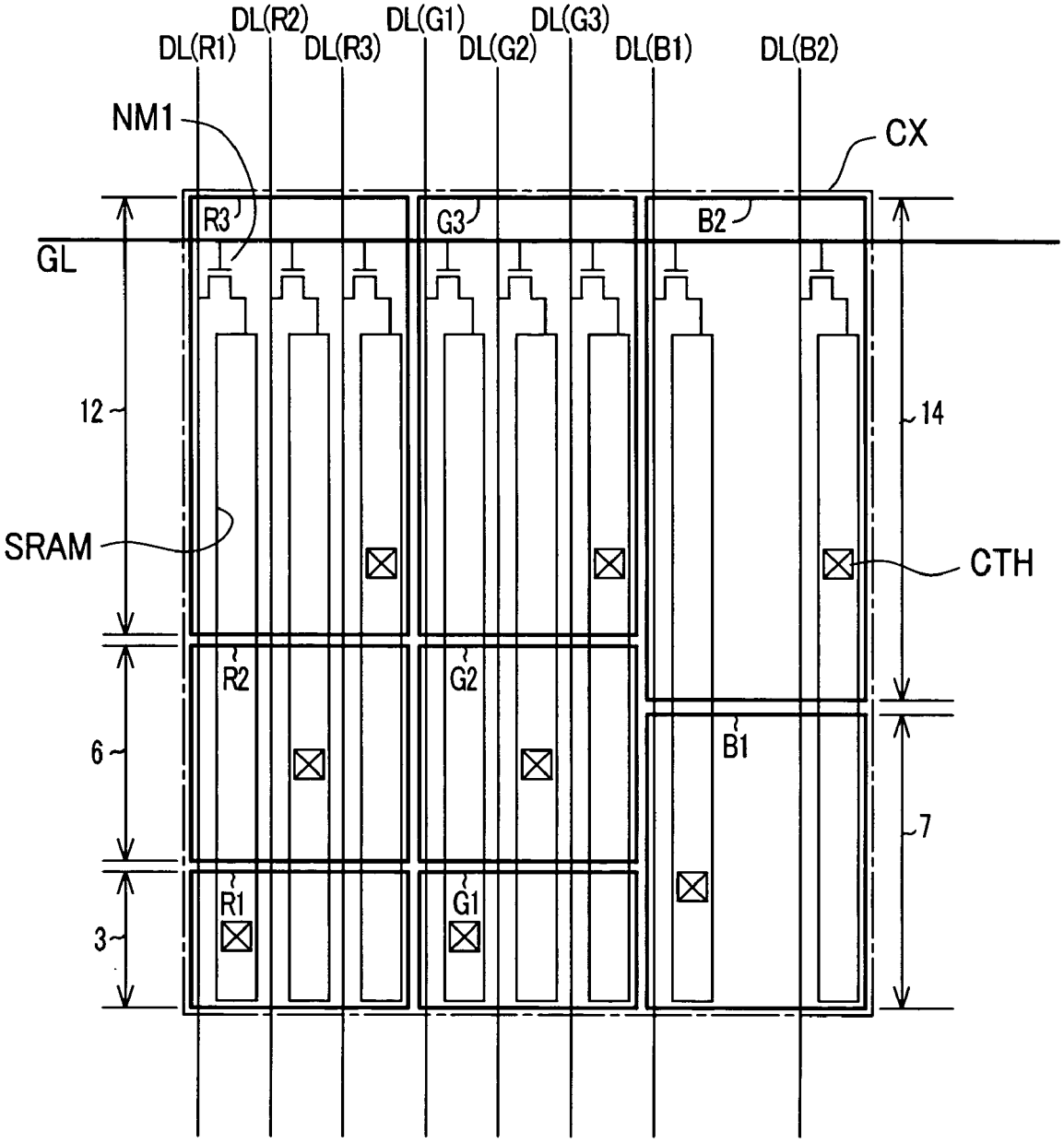
FIG. 12 is a top plan view showing explaining one example of the layout in a display area of one color pixel of the case in which 256 colors are displayed with data of gradations of 3 bits for R, 3 bits for G and 2 bits for B.

FIG. 1 is a circuit diagram of one pixel of a liquid crystal display device representing Embodiment 1 of the invention. As shown in FIG. 11, an image memory (or storage circuit) is provided with: a first transistor pair, which is composed of a transistor (NMOS) NM2 and transistor (PMOS) PM2 connected in series, while bridging a pair of power lines ϕp and ϕn; and a second transistor pair, which is composed of a transistor (NMOS) NM3 and transistor (PMOS) PM3 connected in series, while bridging the paired power lines ϕp and ϕn. The transistor NM2 and the transistor PM2 composing the first transistor pair are connected through diodes D1 and D2 having the same conduction direction as that of the individual transistors NM2 and PM2. That is, the diodes D1 and D2 are connected with the drain sides of the individual transistors NM2 and PM2.

The paired power lines ϕp and ϕn are fed with AC voltages (or alternating voltages) varying in polarities opposite to each other. The common node of the control electrodes of the transistor NM2 and the transistor PM2 composing the first transistor pair of the memory circuit is connected with the series connection intermediate node (or node) N2 of the transistors NM3 and PM3 composing the second transistor pair. Moreover, the common node of the control electrodes of the transistor NM3 and the transistor PM3 composing the second transistor pair is connected with the series connection intermediate node of the transistor NM2 and the transistor PM2 composing the first transistor pair, i.e., a series connection intermediate node (or node) N1 of the diodes D1 and D2.

An NMOS transistor NM1 operates as a switching element (or switching transistor), which is selected by a gate line GL and is supplied with a video signal (or data) from a drain line DL. The output of this switching element NM1 is connected with a node between the transistor NM2 and the transistor PM2 composing the first transistor pair, i.e., the node N1 of the diodes D1 and D2.

Thus, the output node of the switching element NM1 is connected with the node N1 of the transistor NM2 and the transistor PM2 composing the first transistor pair, and the node N2 of the transistor NM3 and the transistor PM3 composing the second transistor pair is connected with the pixel electrode of a unit pixel PX. A bootstrap capacitor CB is inserted between the node N2 of the transistor NM3 and the transistor PM3 composing the second transistor pair and the common node of the control electrodes of the second transistor pair. Reference letters CS designate a floating capacitor.

Figure 2:
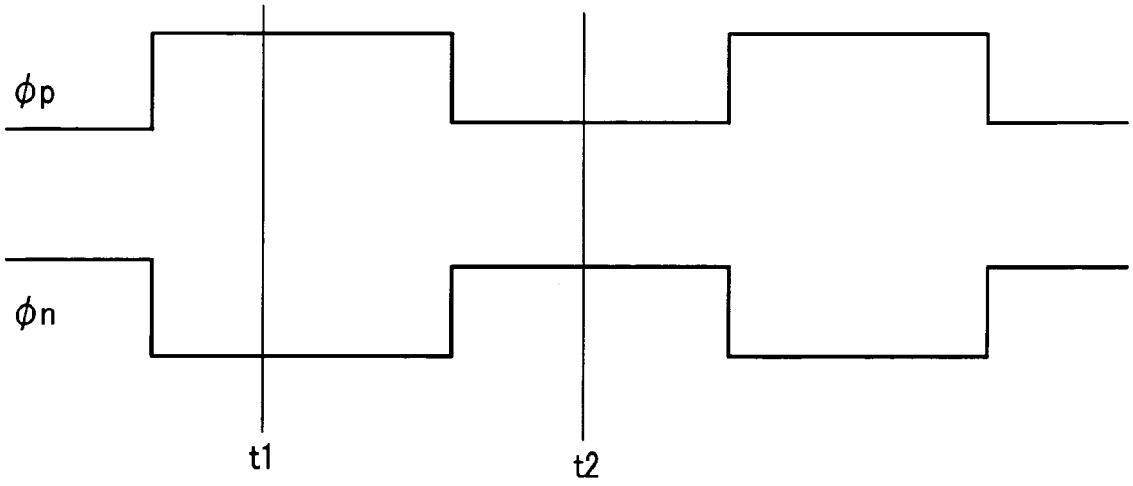
FIG. 2 is a waveform diagram showing one example of alternating voltages to be applied to power lines $\phi p$ and $\phi n$ for driving a liquid crystal.

FIG. 2 is a waveform diagram showing one example of alternating voltages to be applied to power lines ϕp and ϕn for driving a liquid crystal. The liquid crystal driving alternating voltages to be applied to those power lines ϕp and ϕn (although the alternating voltages themselves are designated by ϕp and ϕn for the description) are repeated between a high level and a low level (or a positive level and a negative level). At time t1, the voltage ϕp takes the high level, and the voltage ϕn takes the low level as shown. At time t2, moreover, the voltage ϕp takes the low level and the voltage ϕn takes the high level.

In the circuit of FIG. 1, the gate line GL for the pixel selection takes the low level, and the NMOS transistor NM1 is in the OFF state, so that the image memory is isolated (or floating) with respect to the outside. At this time, the NMOS transistor NM2 and the PMOS transistor PM2 of the first transistor pair, which use the potential of the node N2, which becomes the pixel electrode of a liquid crystal LC, as gate voltages and the common node of which is connected with the node N1, take a general bias relation at the time t2, and the voltages ϕp and ϕn or the drain/source voltages are reversed at the time t1.

At the time of setting the opposite voltages at the time t1 of FIG. 2, the actions may become unstable in the transient state of the potential change at the node N1. As a countermeasure for this, the diodes D1 and D2 are connected in this embodiment in series with the individual transistors NM2 and PM2 of the first transistor pair. Specifically, the diodes D1 and D2 are inserted between the common nodes of the two transistors NM2 and PM2 so that the diode D1 is directed in the conduction direction of the transistor NM2 and the diode D2 is directed in the conduction direction of the transistor PM2.

According to the configuration of this embodiment, only in the generally normal bias case in connection with the CMOS inverter composed of the second transistor pair NM3 and PM3, as indicated at the time t2, will the conduction of the diodes D1 and D2 be directed forward, so that the potential holding current (or charge) is inputted/outputted. In the generally reverse bias case in connection with the transistors PM2 and NM2 composing the CMOS inverter, as indicated at the time t1, on the contrary, the conduction of the diodes D1 and D2 is reversed so as to inhibit the input/output of the potential holding current (or charge). By these actions, the potential of the image memory is reliably held.

[Embodiment 2]

Figure 3:
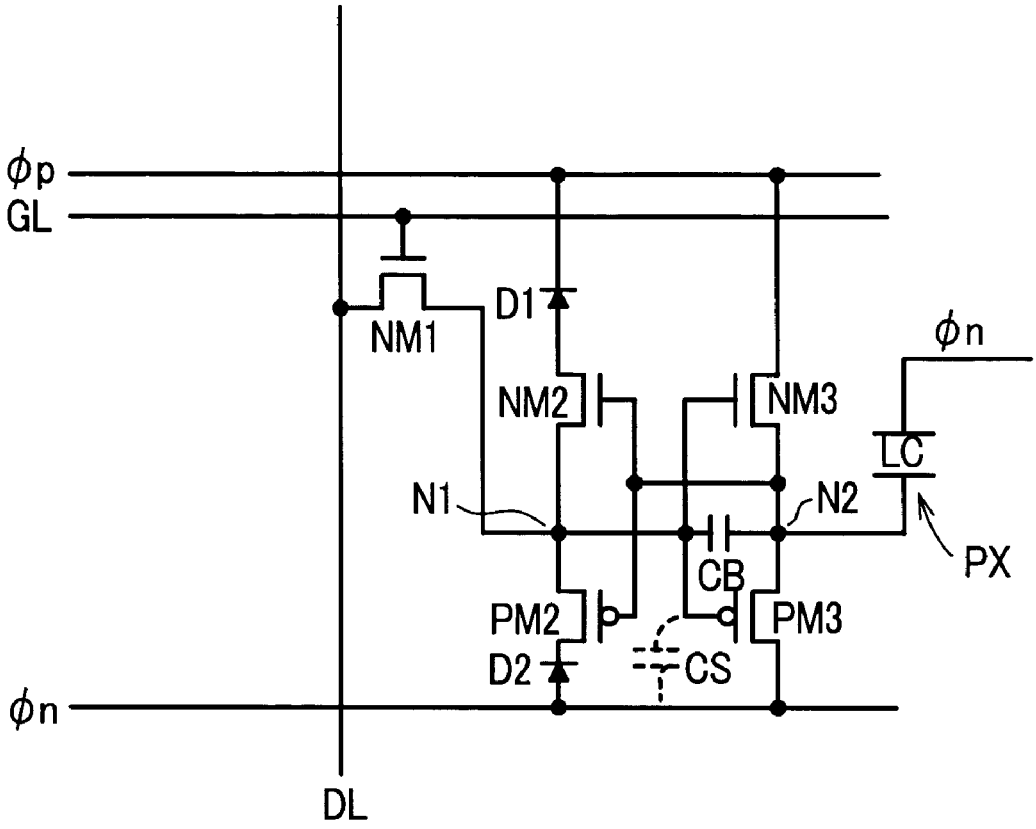
FIG. 3 is a circuit diagram of one pixel of a liquid crystal display device representing Embodiment 2 of the invention.

FIG. 3 is a circuit diagram of one pixel of a liquid crystal display device representing Embodiment 2 of the invention. In this embodiment, the diodes D1 and D2 are located between the power lines ϕp and ϕn of the transistors NM2 and PM2 composing the first transistor pair, that is, on the source side. The remaining features of the circuit configuration and the functions thereof are similar to those of FIG. 1, so that a repeated description thereof will be omitted.

In this embodiment, too, only in the generally normal bias case in connection with the CMOS inverter composed of the second transistor pair NM3 and PM3, as indicated at the time t2 in FIG. 2, will the conduction of the diodes D1 and D2 be directed forward, so that the potential holding current (or charge) is inputted/outputted. In the generally reverse bias case in connection with the transistors PM2 and NM2 composing the CMOS inverter, as indicated at the time t1, on the contrary, the conduction of the diodes D1 and D2 is reversed so as to inhibit the input/output of the potential holding current (or charge). By these actions, the potential of the image memory is reliably held.

[Embodiment 3]

As Embodiment 3 of the invention, similar effects can be obtained by inserting one of the diodes D1 and D2 on the drain side of one of the transistors PM2 and NM2 and the other on the source side, or vice versa.

Now, a specific example of the layout of a portion of an inverter circuit on a substrate, as is composed of the first transistor pair in the pixel circuit, will be described according to the invention.

Figure 4:
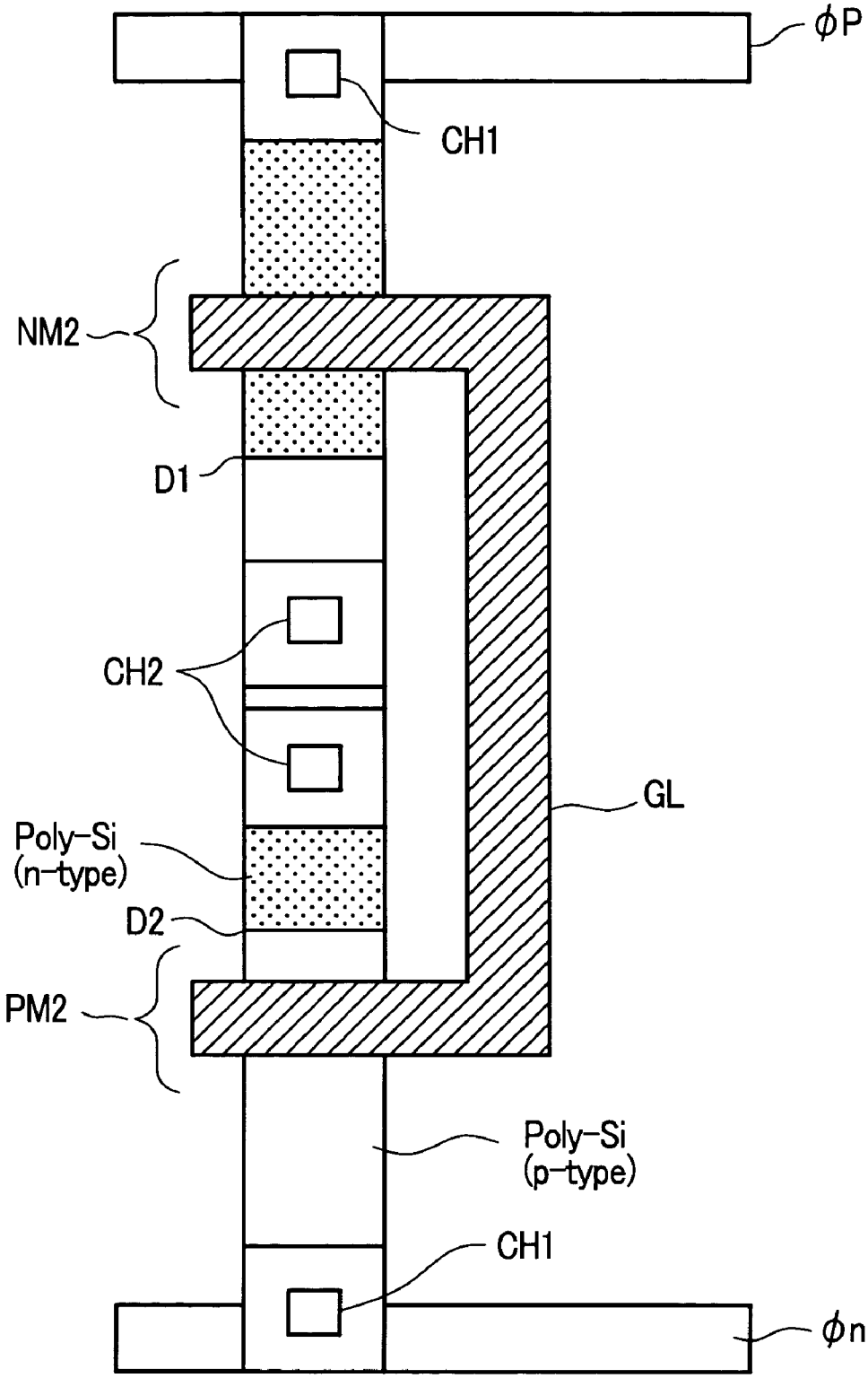
FIG. 4 is a top plan view of a principal portion of a layout of a first transistor pair of Embodiment 1 of the invention, which is shown in FIG. 1.

FIG. 4 is a top plan view of a principal portion showing the layout of the first transistor pair of Embodiment 1 of the invention, which is shown in FIG. 1. In FIG. 4, the same reference characters as those of FIG. 1 correspond to common functional portions. The power lines ϕp and ϕn are suitably made of aluminum (Al). On the other hand, the gate line GL is suitably made of molybdenum-tungsten (MoW). The first transistor pair NM2 and PM2 and the diodes D1 and D2 are formed into a poly-silicon semiconductor layer (Poly-Si). Reference characters CH1 designate contact holes for connecting the semiconductor layer and the wiring layer, and reference characters CH2 designate contact holes for connecting a n-type poly-silicon diffusion layer and a p-type poly-silicon diffusion layer.

Figure 5:
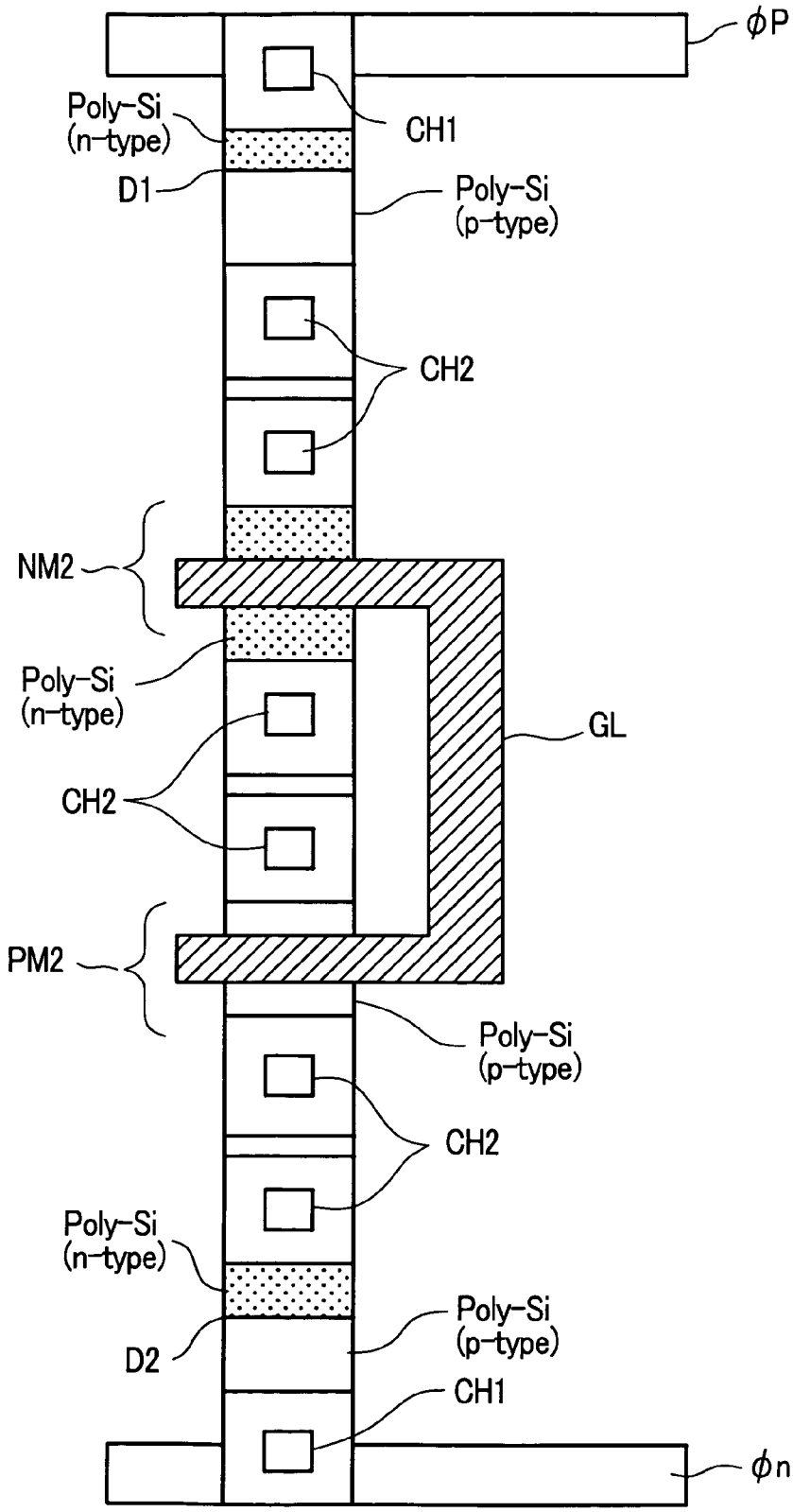
FIG. 5 is a top plan view of a principal portion of a layout of a first transistor pair of Embodiment 2 of the invention, which is shown in FIG. 3.

FIG. 5 is a top plan view of a principal portion showing the layout of the first transistor pair of Embodiment 2 of the invention, which is shown in FIG. 3. In FIG. 5, the same reference characters as those of FIG. 4 correspond to common functional portions. In this example, the number of contact holes for connecting the diodes D1 and D2 with the drains or sources of the transistors NM2 and PM2 is larger than that of FIG. 4. Especially, the area to be occupied by the contact holes for connecting the semiconductor layer and the wiring layer configuring the transistors and the diodes is larger than that assigned to one pixel. As the number of contact holes is smaller, the advantages become greater in practice.

Figure 6:
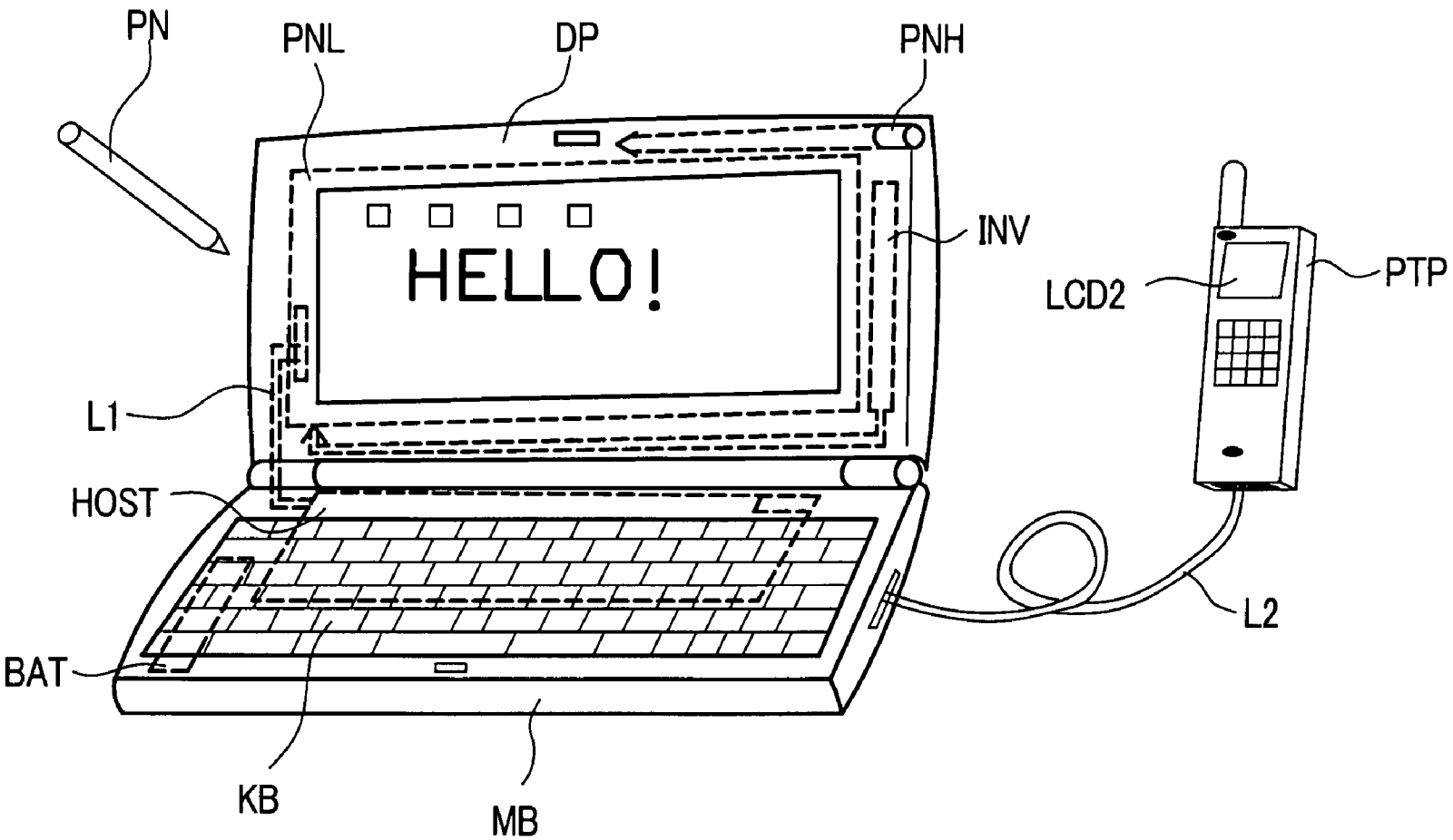
FIG. 6 is a perspective view showing an example of a mobile type information terminal as one example of an electronic device mounting the display device according to the invention.
Figure 7:
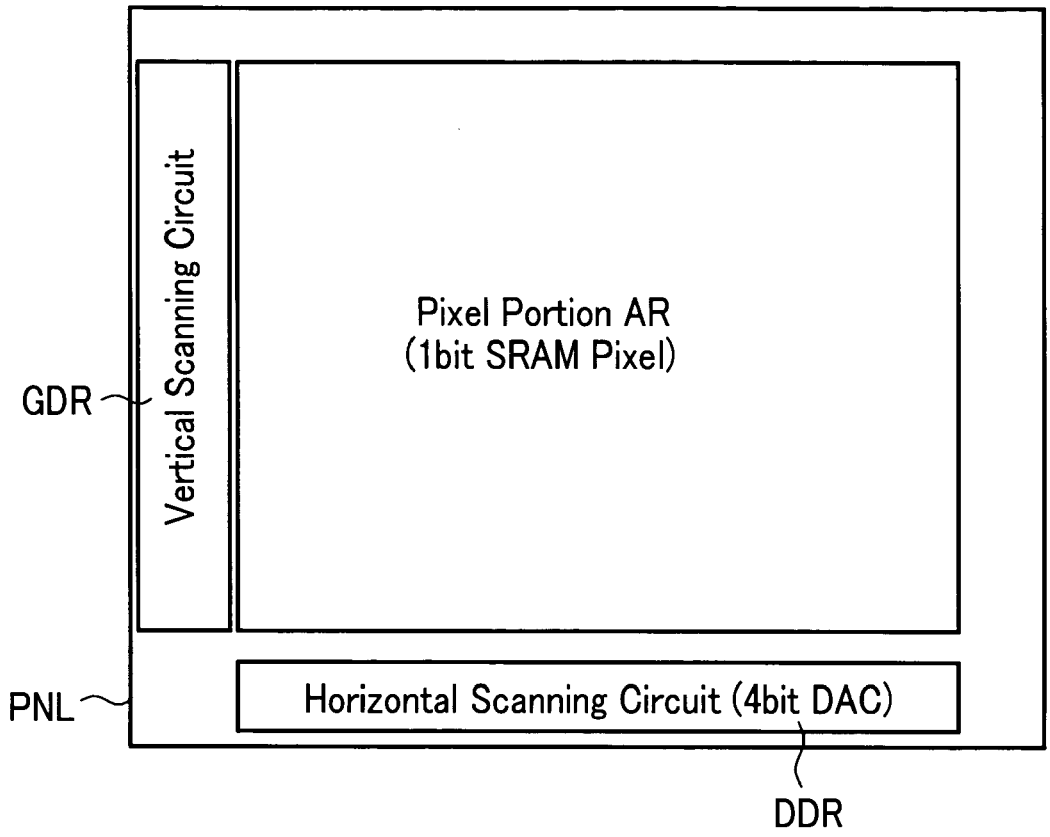
FIG. 7 is a diagram showing an example of a liquid crystal panel, which configures a low temperature poly-silicon thin film transistor type liquid crystal display device having a static RAM of one bit packaged in each pixel.
Figure 8:
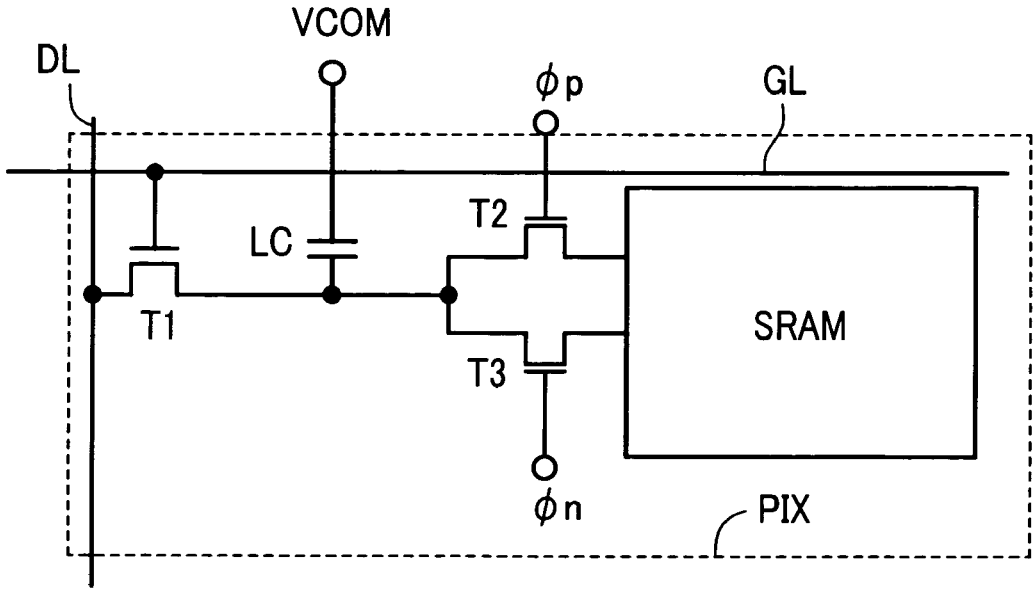
FIG. 8 is a schematic circuit diagram of the 1-bit SRAM in FIG. 7.
Figure 9:
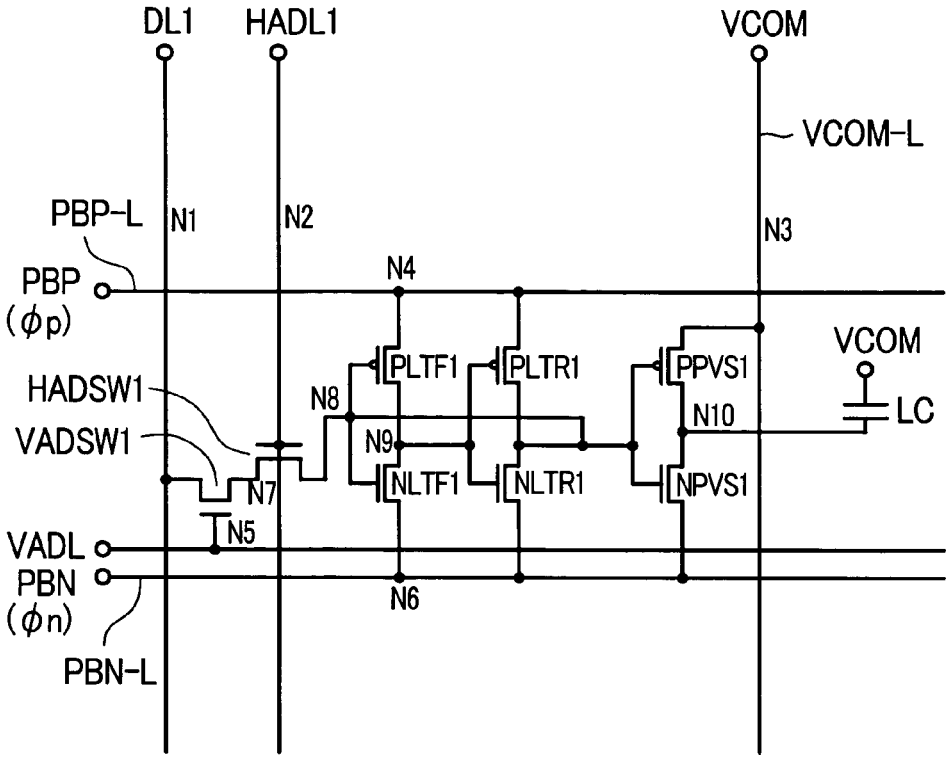
FIG. 9 is a circuit diagram showing an example of one pixel of a liquid crystal display device having an image memory circuit, which has already been proposed by the present applicant.
Figure 10:
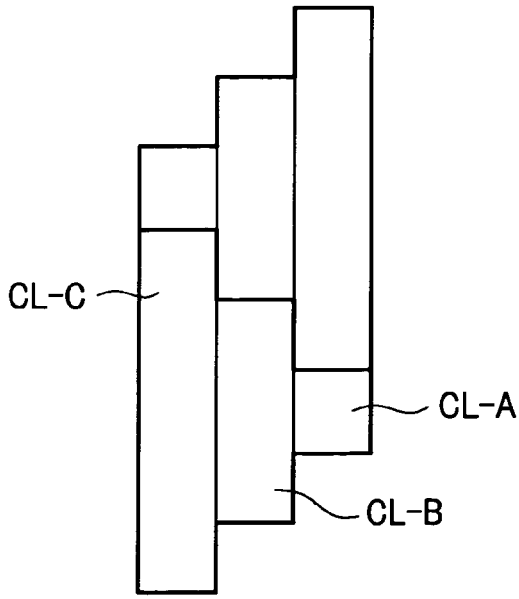
FIG. 10 is a diagram showing an example of an areal gradation pixel, in which the unit pixels of FIG. 9 are combined.

FIG. 6 is a perspective view showing an example of a mobile type information terminal representing one example of an electronic device mounting the display device according to the invention. This mobile type information terminal (PDA) is configured to include: a main body MB housing a host computer HOST and a battery BAT and provided with a keyboard KB on its surface; and a display unit DP using a liquid crystal display device LCD as the display device and an inverter INV for the back light. A mobile telephone PTP can be connected with the main body MB through a connection cable L2 so that it can communicate with a remote.

The liquid crystal display device LCD of the display unit DP and the host computer HOST are connected through an interface cable L1. The liquid crystal display device LCD has an image storing function. Therefore, the data to be transmitted to the display device LCD by the host computer HOST may be only data which is different from that of the preceding display frame, so that no data needs to be transmitted when the display does not change. Thus, the load on the host computer HOST is remarkably lightened. Therefore, an information processing system using the display device of the invention has a low power consumption, can be easily small-sized and can be given a high speed and multiple functions.

Here, the display unit DP of this mobile information terminal is provided with a pen holder PNH in which an input pen PN is housed. The liquid crystal display device is enabled by inputting information using a keyboard KB and by pushing, tracing or writing on the surface of the touch panel with the input pen PN, so as to perform a variety of operations to input various pieces of information and to select the information displayed on a liquid crystal display element PNL or the processing function.

Here, the mobile type information terminal (PDA) of this kind should not have its shape or structure limited to that shown, but may be conceived to have other various shapes, structures and functions. Moreover, the amount of information of display data to be transmitted to a display device LCD2 used in the display unit of the mobile telephone PTP of FIG. 6 can be reduced by using the display device of the invention for the display device LCD2. As a result, the image data to be transmitted with electric waves or communication lines can be reduced to display characters, drawings or photographs of multiple gradations and high definition, as well as moving images.

Moreover, the display device of the invention can naturally be used as a monitor device not only in a mobile type information terminal or mobile telephone, as described with reference to FIG. 6, but also in a desktop type personal computer, a notebook type personal computer, a projection type liquid crystal display device or another type of information terminal.

In addition, the display device of the invention should not be limited in its application to a liquid crystal display device, but also may be applied to any matrix type display device, such as an organic EL display device or a plasma display device.

What is claimed is:

1. A display device comprising:

pixels disposed to correspond to portions, at which a plurality of scanning lines and a plurality of signal lines intersect, wherein each of the pixels includes a pixel electrode, a switching element for selecting the pixel electrode, and a storage circuit interposed between the pixel electrode and the switching element for storing data to be written in the pixel electrode; and a pair of alternating voltage power lines for applying alternating voltages varying in polarities opposite to each other, to the storage circuit, wherein the storage circuit includes a first transistor pair of an NMOS transistor and a PMOS transistor connecting in series while bridging the paired alternating voltage power lines, and a second transistor pair of an NMOS transistor and a PMOS transistor connected in series while bridging the paired alternating voltage power lines, wherein a common node of control electrodes of the first transistor pair is connected with the series connection intermediate node of the second transistor pair whereas a common node of control electrodes of the second transistor pair is connected with the series connection intermediate node of the first transistor pair, wherein diodes having the same conduction direction as that of the NMOS transistor and the PMOS transistor composing the first transistor pair are connected in series with the NMOS transistor and the PMOS transistor composing the first transistor pair, respectively, wherein an output node of the switching element is connected with the node of the first transistor pair whereas the series connection intermediate node of the second transistor pair is connected with the pixel electrode, and wherein a capacitor is connected between the common node of the control electrodes of the second transistor pair and the series connection intermediate node of the second transistor pair.

2. A display device according to claim 1, wherein the diodes are connected individually across the series connection intermediate node of the first transistor pair.

3. A display device according to claim 1, wherein the diodes are connected individually between each of the NMOS transistor and the PMOS transistor composing the first transistor pair, and the paired alternating voltage power lines.

4. A display device according to claim 1, wherein assuming each of the pixels to be a unit pixel of one color, one color pixel is composed of a plurality of the unit pixels.

5. A display device according to claim 4, wherein the pixel electrodes of the individual unit pixels composing one color pixel are made of a plurality of electrodes having different areas.

6. A display device according to claim 5, wherein the plural electrodes are so selected by the switching element as to correspond to the gradation display of at least 2 bits.

* * * * *